US007441541B2

(12) United States Patent
Nakamura et al.

(10) Patent No.: US 7,441,541 B2
(45) Date of Patent: Oct. 28, 2008

(54) INTERNAL COMBUSTION ENGINE STOP AND START METHOD

(75) Inventors: Makoto Nakamura, Okazaki (JP); Mitsuhiro Tabata, Suntou-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 93 days.

(21) Appl. No.: 11/662,543

(22) PCT Filed: Nov. 15, 2005

(86) PCT No.: PCT/JP2005/021319

§ 371 (c)(1),
(2), (4) Date: Mar. 12, 2007

(87) PCT Pub. No.: WO2006/054734

PCT Pub. Date: May 26, 2006

(65) Prior Publication Data

US 2008/0115760 A1 May 22, 2008

(30) Foreign Application Priority Data

Nov. 17, 2004 (JP) ..... 2004-332809
Dec. 22, 2004 (JP) ..... 2004-370876

(51) Int. Cl.
*F02D 31/00* (2006.01)

(52) U.S. Cl. ..... 123/333; 123/493; 123/436; 123/179.4

(58) Field of Classification Search ..... 123/436, 123/481, 491–493, 333, 198 DB, 179.4
See application file for complete search history.

(56) References Cited

U.S. PATENT DOCUMENTS

| | | | | |
|---|---|---|---|---|
| 4,364,343 | A | 12/1982 | Malik | |
| 6,839,621 | B2 * | 1/2005 | Kaneko | 701/112 |
| 7,011,063 | B2 * | 3/2006 | Condemine et al. | 123/179.4 |
| 2003/0041831 | A1 | 3/2003 | Aoki et al. | |
| 2004/0216719 | A1 | 11/2004 | Condemine et al. | |
| 2008/0066706 | A1 * | 3/2008 | Nakamura et al. | 123/179.4 |
| 2008/0072860 | A1 * | 3/2008 | Nakamura et al. | 123/179.4 |
| 2008/0091328 | A1 * | 4/2008 | Tabata et al. | 701/102 |

FOREIGN PATENT DOCUMENTS

| | | | |
|---|---|---|---|
| DE | 195 27 503 | A1 | 1/1997 |
| DE | 100 30 001 | A1 | 7/2001 |
| DE | 602 06 799 | T2 | 4/2006 |
| EP | 1 288 491 | A2 | 3/2003 |
| JP | A-2001-225674 | | 8/2001 |
| JP | A 2001-342876 | | 12/2001 |
| JP | A 2004-036428 | | 2/2004 |
| JP | A 2004-263569 | | 9/2004 |

* cited by examiner

*Primary Examiner*—Hai H Huynh
(74) *Attorney, Agent, or Firm*—Oliff & Berridge, PLC

(57) ABSTRACT

Fuel injection is controlled to cause one of multiple cylinders to receive fuel injection and to stop in a predetermined range over an intake stroke to a compression stroke in an operation stop of the internal combustion engine. At the time of stopping the engine, fuel injection is allowed only while the observed rotation speed of the internal combustion engine is between a preset start rotation speed and a preset stop rotation speed, and at least one of the start rotation speed and the stop rotation speed are regulated based on a detected rotation stop position of a crankshaft in the operation stop of the internal combustion engine and a state of fuel injection in the cylinder stopping in the predetermined range.

16 Claims, 5 Drawing Sheets

INTERNAL COMBUSTION ENGINE STOP AND START METHOD

TECHNICAL FIELD

The present invention relates to an internal combustion engine system having an internal combustion engine, a motor vehicle equipped with an internal combustion engine system, and an internal combustion engine stop method to stop operation of the internal combustion engine.

BACKGROUND ART

A proposed internal combustion engine system enables ignition of an air-fuel mixture for combustion in a cylinder having a first ignition timing at an auto restart of an internal combustion engine after its auto stop (see, for example, Japanese Patent Laid-Open Gazette No. 2001-342876). The ignition and combustion of the air-fuel mixture in the cylinder having the first ignition timing achieves a quick restart of the internal combustion engine.

DISCLOSURE OF THE INVENTION

In an internal combustion engine where a fuel is individually injected into respective intake systems of multiple cylinders, for example, four cylinders or six cylinders, the fuel injection is generally performed in a final phase of an exhaust stroke. The ignition and combustion of the air-fuel mixture in the cylinder having the first ignition timing accordingly requires fuel injection in the final phase of the exhaust stroke immediately before a stop of the internal combustion engine into the cylinder that stops in a certain range from an intake stroke to a compression stroke in the stop of the internal combustion engine. An adequate degree of compression in the cylinder is also required for the ignition and combustion of the air-fuel mixture in the cylinder. Fuel injection is thus to be performed in the cylinder that stops in an adequate range from the intake stroke to the compression stroke. According to the experimental findings, the stop positions of the respective cylinders in an operation stop of the internal combustion engine are correlated to the rotation speed of the internal combustion engine. Permission for fuel injection in a specific rotation speed range of the internal combustion engine enables fuel injection in a cylinder stopping in an adequate range over the intake stroke to the compression stroke. The varying state and the aging phenomena of the internal combustion engine, however, cause a change in stop position of the internal combustion engine and may interfere with desired fuel injection in the cylinder stopping in the adequate range.

In an internal combustion engine system including an internal combustion engine that has multiple cylinders and is capable of individually receiving fuel injection in an intake system in each of the multiple cylinders, a motor vehicle equipped with such an internal combustion engine system, and a corresponding internal combustion engine stop method, the object of the invention is to ensure fuel injection in a cylinder stopping in a predetermined range. In the internal combustion engine system, the motor vehicle equipped with the internal combustion engine system, and the internal combustion engine stop method, the object of the invention is also to enable a quick restart of the internal combustion engine after an operation stop.

In order to attain at least part of the above and the other related objects, the internal combustion engine system of the invention, the motor vehicle equipped with the internal combustion engine system, and the corresponding internal combustion engine stop method have the configurations discussed below.

The present invention is directed to an internal combustion engine system including an internal combustion engine that has multiple cylinders and is capable of receiving fuel injection in an intake system in each of the multiple cylinders. The internal combustion engine system includes: a fuel injection unit that is capable of individually injecting a fuel into the intake system in each of the multiple cylinders of the internal combustion engine; a rotation speed measurement unit that measures a rotation speed of the internal combustion engine; an engine stop-time fuel injection control module that, in response to a preset operation stop command of the internal combustion engine, controls the fuel injection unit to make fuel injection in a cylinder that stops in a predetermined range including part of a compression stroke in an operation stop of the internal combustion engine, the control of the fuel injection unit by said engine stop-time fuel injection control module prohibiting fuel injection until the measured rotation speed of the internal combustion engine is lowered to a preset start rotation speed, allowing fuel injection while the measured rotation speed of the internal combustion engine is between the preset start rotation speed and a preset stop rotation speed, and prohibiting fuel injection again after the measured rotation speed of the internal combustion engine is lowered to the preset stop rotation speed; a rotation stop position detection unit that detects a rotation stop position of a crankshaft of the internal combustion engine in the operation stop of the internal combustion engine; and a start rotation speed/stop rotation speed regulation module that regulates at least one of the start rotation speed and the stop rotation speed, based on the detected rotation stop position and a state of fuel injection in the cylinder stopping in the predetermined range.

In response to a preset operation stop command of the internal combustion engine, the internal combustion engine system of the invention controls the fuel injection unit to make fuel injection in the cylinder that stops in the predetermined range over the intake stroke to the compression stroke in an operation stop of the internal combustion engine. The fuel injection unit is capable of individually injecting the fuel into the intake system in each of the multiple cylinders of the internal combustion engine. The fuel injection unit is controlled to prohibit fuel injection until the observed rotation speed of the internal combustion engine is lowered to the preset start rotation speed, to allow fuel injection while the observed rotation speed of the internal combustion engine is between the preset start rotation speed and the preset stop rotation speed, and to prohibit fuel injection again after the observed rotation speed of the internal combustion engine is lowered to the preset stop rotation speed. The start rotation speed and the stop rotation speed are regulated, based on the detected rotation stop position of the crankshaft in the operation stop of the internal combustion engine and the state of fuel injection in the cylinder stopping in the predetermined range over the intake stroke to the compression stroke in the operation stop of the internal combustion engine. Such control ensures fuel injection in the cylinder that stops in the predetermined range over the intake stroke to the compression stroke, even under the condition of the changing stop position of the internal combustion engine due to the varying state and the aging phenomena of the internal combustion engine. At a restart of the internal combustion engine, the air-fuel mixture is ignited at an ignition timing over the compression stroke to an expansion stroke in the cylinder that has stopped in the predetermined range over the intake stroke to the compression stroke. This ensures a quick start of the internal combustion engine. The predetermined range may include parts of the intake stroke and the compression stroke.

In one preferable arrangement of the internal combustion engine system of the invention, the start rotation speed/stop rotation speed regulation module may regulate at least one of the start rotation speed and the stop rotation speed to narrow a range between the start rotation speed and the stop rotation speed, when a cylinder stopping out of the predetermined range receives fuel injection. This arrangement enables adequate regulation of the start rotation speed and the stop rotation speed to make fuel injection in the cylinder stopping in the predetermined range. The start rotation speed/stop rotation speed regulation module may decrease the start rotation speed when the cylinder with fuel injection is close to a top dead center in the compression stroke and stops out of the predetermined range. The start rotation speed/stop rotation speed regulation module may increase the stop rotation speed when the cylinder with fuel injection is in an intake stroke before the compression stroke and stops out of the predetermined range.

In another preferable arrangement of the internal combustion engine system of the invention, the start rotation speed/stop rotation speed regulation module may regulate at least one of the start rotation speed and the stop rotation speed to widen a range between the start rotation speed and the stop rotation speed, when the cylinder stopping in the predetermined range does not receive fuel injection. This arrangement enables adequate regulation of the start rotation speed and the stop rotation speed to make fuel injection in the cylinder stopping in the predetermined range. The start rotation speed/stop rotation speed regulation module may increase the start rotation speed when the cylinder without fuel injection is close to a top dead center in the compression stroke and stops in the predetermined range. The start rotation speed/stop rotation speed regulation module may decrease the stop rotation speed when the cylinder without fuel injection is in an intake stroke before the compression stroke and stops in the predetermined range.

Further, in one preferable arrangement of the internal combustion engine system of the invention, the preset operation stop command may be given under a preset auto stop condition in the process of automatically stopping the internal combustion engine and automatically restarting the stopped internal combustion engine. In this case, the internal combustion engine system may further include: an engine start control module that, under a preset auto start condition, ignites a mixture of the air and the fuel when the cylinder stopping in the predetermined range shifts from the compression stroke to an expansion stroke to start the internal combustion engine.

The present invention is also directed to a motor vehicle driven with output power of an internal combustion engine that has multiple cylinders and is capable of receiving fuel injection in an intake system in each of the multiple cylinders. The motor vehicle includes: a fuel injection unit that is capable of individually injecting a fuel into the intake system in each of the multiple cylinders of the internal combustion engine; a rotation speed measurement unit that measures a rotation speed of the internal combustion engine; an engine stop-time fuel injection control module that, in response to a preset operation stop command of the internal combustion engine, controls the fuel injection unit to make fuel injection in a cylinder that stops in a predetermined range including part of a compression stroke in an operation stop of the internal combustion engine, the control of the fuel injection unit by said engine stop-time fuel injection control module prohibiting fuel injection until the measured rotation speed of the internal combustion engine is lowered to a preset start rotation speed, allowing fuel injection while the measured rotation speed of the internal combustion engine is between the preset start rotation speed and a preset stop rotation speed, and prohibiting fuel injection again after the measured rotation speed of the internal combustion engine is lowered to the preset stop rotation speed; a rotation stop position detection unit that detects a rotation stop position of a crankshaft of the internal combustion engine in the operation stop of the internal combustion engine; and a start rotation speed/stop rotation speed regulation module that regulates at least one of the start rotation speed and the stop rotation speed, based on the detected rotation stop position and a state of fuel injection in the cylinder stopping in the predetermined range.

In response to a preset operation stop command of the internal combustion engine, the motor vehicle of the invention controls the fuel injection unit to make fuel injection in the cylinder that stops in the predetermined range over the intake stroke to the compression stroke in an operation stop of the internal combustion engine. The fuel injection unit is capable of individually injecting the fuel into the intake system in each of the multiple cylinders of the internal combustion engine. The fuel injection unit is controlled to prohibit fuel injection until the observed rotation speed of the internal combustion engine is lowered to the preset start rotation speed, to allow fuel injection while the observed rotation speed of the internal combustion engine is between the preset start rotation speed and the preset stop rotation speed, and to prohibit fuel injection again after the observed rotation speed of the internal combustion engine is lowered to the preset stop rotation speed. The start rotation speed and the stop rotation speed are regulated, based on the detected rotation stop position of the crankshaft in the operation stop of the internal combustion engine and the state of fuel injection in the cylinder stopping in the predetermined range over the intake stroke to the compression stroke in the operation stop of the internal combustion engine. Such control ensures fuel injection in the cylinder that stops in the predetermined range over the intake stroke to the compression stroke, even under the condition of the changing stop position of the internal combustion engine due to the varying state and the aging phenomena of the internal combustion engine. At a restart of the internal combustion engine, the air-fuel mixture is ignited at an ignition timing over the compression stroke to an expansion stroke in the cylinder that has stopped in the predetermined range over the intake stroke to the compression stroke. This ensures a quick start of the internal combustion engine. The predetermined range may include parts of the intake stroke and the compression stroke.

In one preferable arrangement of the motor vehicle of the invention, the start rotation speed/stop rotation speed regulation module may regulate at least one of the start rotation speed and the stop rotation speed to narrow a range between the start rotation speed and the stop rotation speed, when a cylinder stopping out of the predetermined range receives fuel injection. This arrangement enables adequate regulation of the start rotation speed and the stop rotation speed to make fuel injection in the cylinder stopping in the predetermined range. In another preferable arrangement of the motor vehicle of the invention, the start rotation speed/stop rotation speed regulation module may regulate at least one of the start rotation speed and the stop rotation speed to widen a range between the start rotation speed and the stop rotation speed, when the cylinder stopping in the predetermined range does not receive fuel injection. This arrangement enables adequate regulation of the start rotation speed and the stop rotation speed to make fuel injection in the cylinder stopping in the predetermined range.

The present invention is also directed to an internal combustion engine stop method that stops an operation of an internal combustion engine having multiple cylinders and being capable of individually receiving fuel injection in an intake system in each of the multiple cylinders. The internal combustion engine stop method including the step of: controlling fuel injection, in order to cause one of the multiple cylinders to receive fuel injection and to stop in a predetermined range over an intake stroke to a compression stroke in an operation stop of the internal combustion engine. The fuel injection control step including the steps of: prohibiting fuel injection until an observed rotation speed of the internal combustion engine is lowered to a preset start rotation speed; allowing fuel injection while the observed rotation speed of the internal combustion engine is between the preset start rotation speed and a preset stop rotation speed; and prohibiting fuel injection again after the observed rotation speed of the internal combustion engine is lowered to the preset stop rotation speed. The internal combustion engine stop method further including the step of: regulating at least one of the start rotation speed and the stop rotation speed, based on a detected rotation stop position of a crankshaft in the operation stop of the internal combustion engine and a state of fuel injection in the cylinder stopping in the predetermined range over the intake stroke to the compression stroke in the operation stop of the internal combustion engine.

The internal combustion engine stop method of the invention makes fuel injection in the cylinder that stops in the predetermined range over the intake stroke to the compression stroke in an operation stop of the internal combustion engine. The start rotation speed to resume the prohibited fuel injection and the stop rotation speed to prohibit the resumed fuel injection are regulated, based on the detected rotation stop position of the crankshaft in the operation stop of the internal combustion engine and the state of fuel injection in the cylinder stopping in the predetermined range over the intake stroke to the compression stroke in the operation stop of the internal combustion engine. Such control ensures fuel injection in the cylinder that stops in the predetermined range over the intake stroke to the compression stroke, even under the condition of the changing stop position of the internal combustion engine due to the varying state and the aging phenomena of the internal combustion engine. At a restart of the internal combustion engine, the air-fuel mixture is ignited at an ignition timing over the compression stroke to an expansion stroke in the cylinder that has stopped in the predetermined range over the intake stroke to the compression stroke. This ensures a quick start of the internal combustion engine.

In the internal combustion engine stop method of the invention, the regulating step may regulate at least one of the start rotation speed and the stop rotation speed to narrow a range between the start rotation speed and the stop rotation speed, when a cylinder stopping out of the predetermined range receives fuel injection. This arrangement enables adequate regulation of the start rotation speed and the stop rotation speed to make fuel injection in the cylinder stopping in the predetermined range. Further, in the internal combustion engine stop method of the invention, the regulating step may regulate at least one of the start rotation speed and the stop rotation speed to widen a range between the start rotation speed and the stop rotation speed, when the cylinder stopping in the predetermined range does not receive fuel injection. This arrangement enables adequate regulation of the start rotation speed and the stop rotation speed to make fuel injection in the cylinder stopping in the predetermined range.

BEST MODES OF CARRYING OUR THE INVENTION

Figure 1:
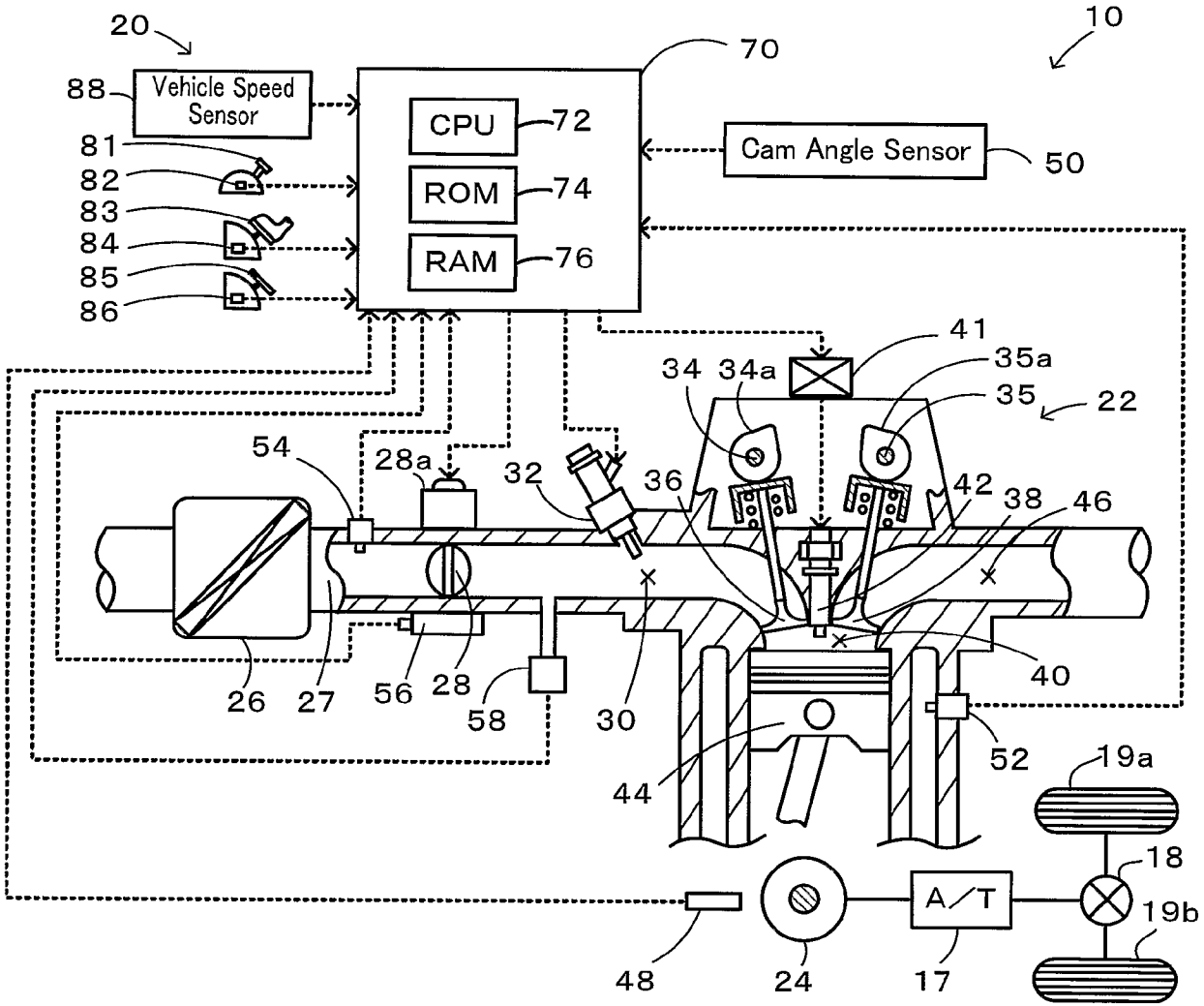
FIG. 1 schematically illustrates the configuration of a motor vehicle equipped with an internal combustion engine system in one embodiment of the invention.

One mode of carrying out the invention is described below as a preferred embodiment. FIG. 1 schematically illustrates the configuration of a motor vehicle 10 equipped with an internal combustion engine system 20 in one embodiment of the invention. As illustrated, the motor vehicle 10 includes an engine 22 driven with gasoline, an engine electronic control unit (hereafter referred to as engine ECU) 70 that controls the engine 22, an automatic transmission (AT) 17 that converts power of a crankshaft 24 of the engine 22 and outputs the converted power to drive wheels 19*a* and 19*b* via a differential gear 18, and an AT electronic control unit (not shown) that controls the automatic transmission 17. The engine 22 and the engine ECU 70 constitute the internal combustion engine system 20 of the embodiment.

Figure 2:
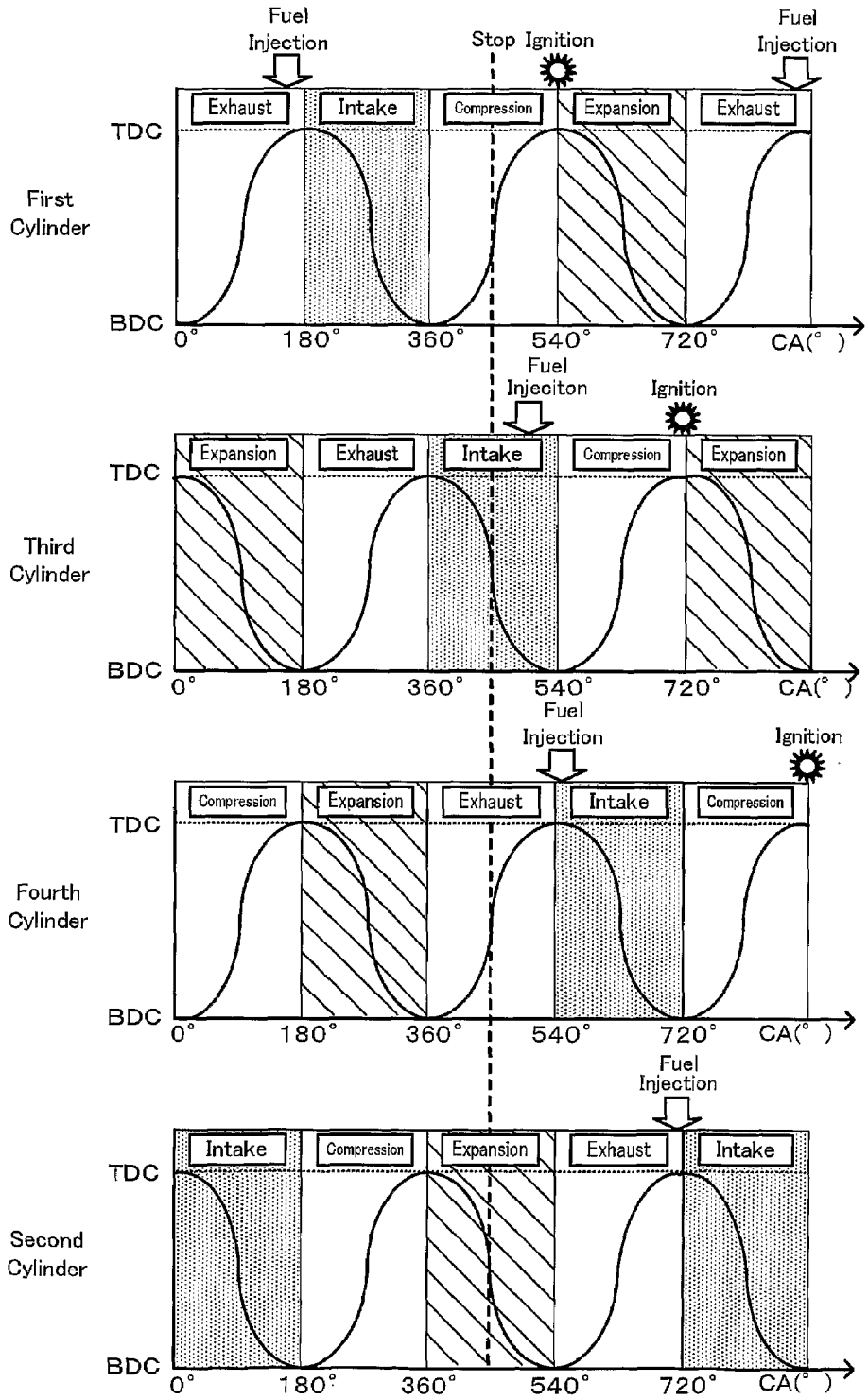
FIG. 2 shows one example of variations of a crank angle CA in four strokes in four cylinders of an engine included in the internal combustion engine system of the embodiment.

The engine 22 is an individual-injection-type 4-cylinder engine that is capable of individually injecting a fuel in respective cylinders 22*a* to 22*d* of an intake manifold 30. Each of the four cylinders 22*a* to 22*d* in the engine 22 is driven in a cycle including an intake stroke, a compression stroke, an expansion stroke (combustion stroke), and an exhaust stroke. The first cylinder 22*a*, the second cylinder 22*b*, the third cylinder 22*c*, and the fourth cylinder 22*d* are arranged in series in this sequence, while the first cylinder 22*a*, the third cylinder 22*c*, the fourth cylinder 22*d*, and the second cylinder 22*b* are linked to the crankshaft 24 to have different crank angles CA by 180 degrees in this sequence. FIG. 2 shows variations of the crank angle CA in four strokes of the respective cylinders 22*a* to 22*d*. FIG. 2 also shows a fuel injection timing in engine stop control and a fuel injection timing and an ignition timing in an engine start control, which will be discussed later.

The engine 22 has an air cleaner 26 that cleans the intake air, a throttle valve 28 that is attached to an intake pipe 27 and is driven by a throttle motor 28*a* to regulate the amount of intake air, fuel injection valves 32 that are attached to branches of the intake manifold 30 diverging corresponding to the four cylinders 22*a* to 22*d* to individually inject a fuel, that is, gasoline, in the respective cylinders 22*a* to 22*d*, and an intake valve 36 that is driven by a cam 34*a* of a cam shaft 34 rotating at a ratio of 1 rotation to 2 rotations of the crankshaft 24 to introduce the mixture of gasoline and the air (the air-fuel mixture) into respective combustion chambers 40. The engine 22 also includes an ignition plug 42 that applies a voltage to an ignition coil 41 integrated with an igniter at a timing from a compression stroke to an expansion stroke to generate an electric spark in the combustion chamber 40, an exhaust valve 38 that is driven by a cam 35*a* of a cam shaft 35 rotating at a ratio of 1 rotation to 2 rotations of the crankshaft 24 to discharge the combustion exhaust gas from the combustion chamber 40 into an exhaust manifold 46, and a catalytic converter (not shown) of a three-way catalyst that converts toxic compounds in the exhaust gas, that is, carbon monoxide (CO), hydrocarbons (HC), and nitrogen oxides (NOx). The reciprocating motions of a piston 44 pressed down by the energy of explosive combustion of the air-fuel mixture in the combustion chamber 40 are converted into the rotating motions of the crankshaft 24.

A crank angle sensor 48 is mounted on the crankshaft 24 of the engine 22 to measure a crank angle CA as a rotation angle of the crankshaft 24. A cam angle sensor 50 is mounted on each of the cam shafts 34 and 35 to measure a cam angle as a rotation angle of the cam shaft 34 or 35. The engine 22 is also equipped with various sensors to observe the conditions of the engine 22. Such sensors include a water temperature sensor 52 that measures the temperature of cooling water in the engine 22, an intake air temperature sensor 54 that measures the temperature of the intake air, a throttle valve position sensor 56 that detects the position of the throttle valve 28 or the throttle position, and a vacuum sensor 58 that measures the amount of intake air as the load of the engine 22. Output signals of these sensors are input into the engine ECU 70. The crank angle sensor 48 is an MRE rotation sensor having a magnetic resistance element arranged at a position to face a magnet rotor (not shown) attached to the crankshaft 24. The crank angle sensor 48 generates a pulse at every preset angle (for example, at every crank angle CA of 10 degrees). In the structure of this embodiment, the engine ECU 70 specifies the crank angle CA or the rotation angle of the crankshaft 24 in response to the pulses generated by the crank angle sensor 48 and computes rotation speed Ne of the engine 22.

The engine ECU 70 is constructed as a microcomputer including a CPU 72, a ROM 74 that stores processing programs, a RAM 76 that temporarily store data, input and output ports (not shown), and a communication port (not shown). The engine ECU 70 receives via its input port, signals from the various sensors, that is, the crank angle CA from the crank angle sensor 48, the cam angles from the cam angle sensors 50, the temperature of cooling water from the water temperature sensor 52, the temperature of the intake air from the intake air temperature sensor 54, the throttle position from the throttle valve position sensor 56, and the amount of intake air from the vacuum sensor 58. The engine ECU 70 also receives, via its input port, a gearshift position SP or a current setting position of a gearshift lever 81 from a gearshift position sensor 82, an accelerator opening Acc or the driver's depression amount of an accelerator pedal 83 from an accelerator pedal position sensor 84, a brake pedal position BP or the driver's depression amount of a brake pedal 85 from a brake pedal position sensor 86, and a vehicle speed V from a vehicle speed sensor 88. The engine ECU 70 outputs, via its output port, driving signals to the fuel injection valves 32 and to the throttle motor 28*a* that adjusts the position of the throttle valve 28, as well as control signals to the ignition coil 41.

The description now regards the operations of the internal combustion engine system 20 mounted on the motor vehicle 10 of the embodiment having the configuration discussed above, especially a series of engine stop control at an idle stop of the engine 22. In the motor vehicle 10 of the embodiment, the engine 22 automatically stops under preset auto stop conditions, for example, the vehicle speed V equal to 0 and the driver's depression of the brake pedal 85. The engine 22 automatically starts under preset auto restart conditions, for example, the driver's release of the depressed brake pedal 85 after an auto stop of the engine 22. The auto stop control and the auto start control of the engine 22 are not characteristic of the invention and are thus not described in detail.

Figure 3:
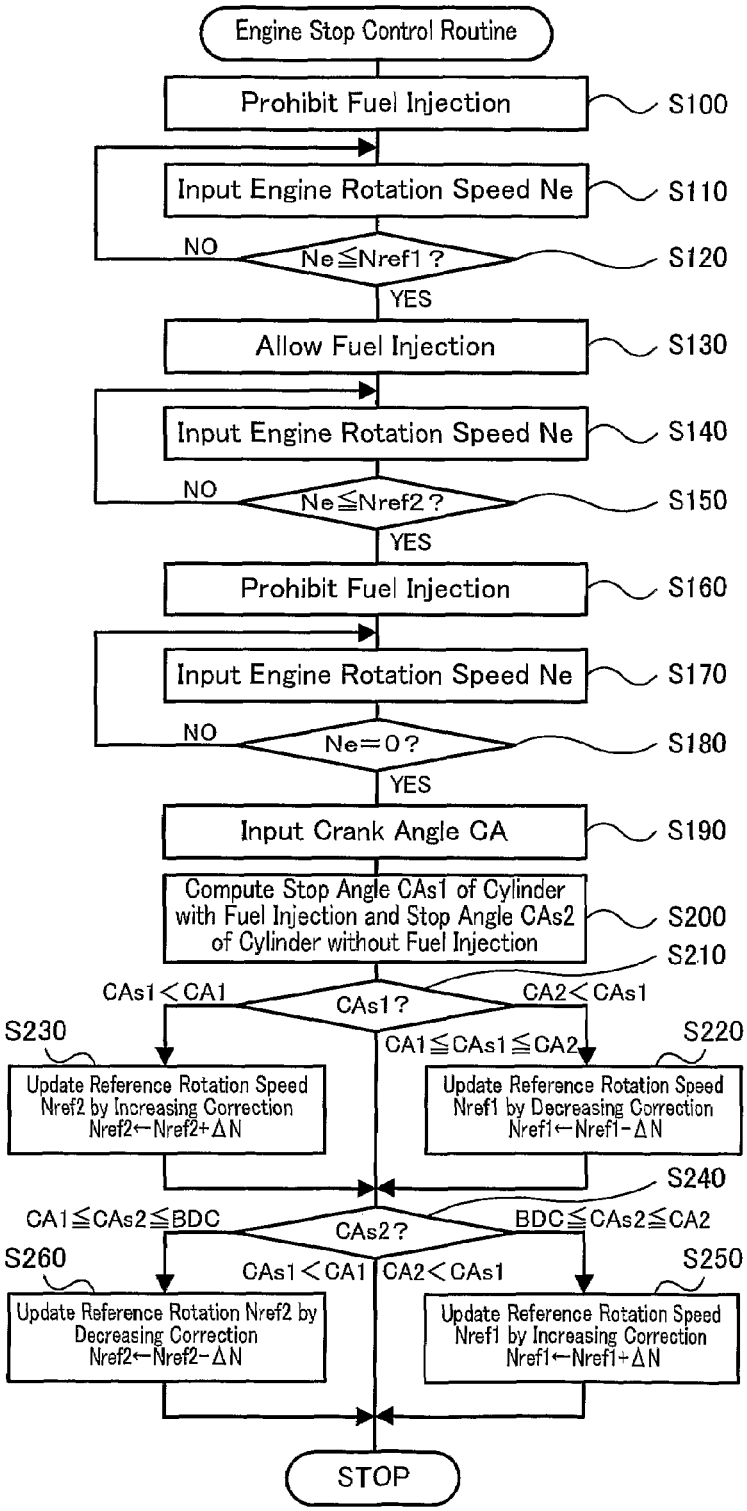
FIG. 3 is a flowchart showing an engine stop control routine executed by an engine ECU included in the internal combustion engine system of the embodiment.

FIG. 3 is a flowchart showing an engine stop control routine executed by the engine ECU 70 under the preset auto stop conditions. In the engine stop control routine of FIG. 3, the CPU 72 of the engine ECU 70 first prohibits fuel injection into the respective cylinders 22*a* to 22*d* (step S100). The prohibition of fuel injection cuts off the fuel and thereby lowers the rotation speed Ne of the engine 22.

Figure 4:
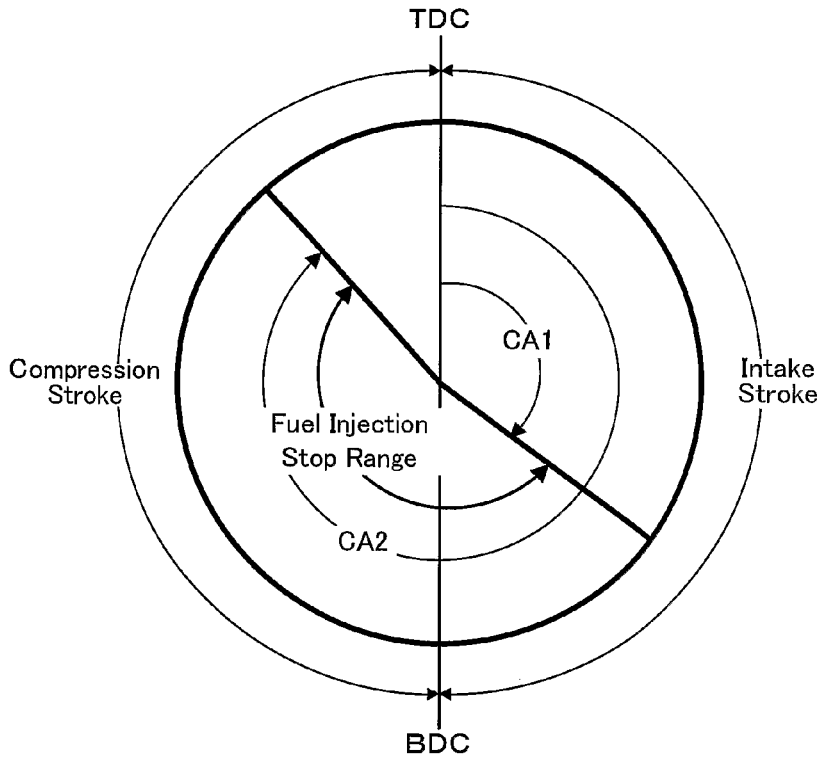
FIG. 4 shows one example of a fuel injection stop range.

The CPU 72 waits until the input rotation speed Ne of the engine 22 decreases to or below a preset fuel injection-start reference rotation speed Nref1 (steps S110 and S120), and then allows fuel injection (step S130). In this embodiment, the input rotation speed Ne of the engine 22 is computed from pulses generated by the crank angle sensor 48 according to an engine rotation speed computation routine (not shown). The rotation speed Ne of the engine 22 may otherwise be measured and input directly. The fuel injection-start reference rotation speed Nref1 is set as a maximum rotation speed that allows fuel injection in a specified cylinder immediately before a full stop of the engine 22. The specified cylinder stops at the crank angle CA in a range of a preset first angle CA1 to a preset second angle CA2 (hereafter referred to as fuel injection stop range) over the intake stroke to the compression stroke in a stop of the engine 22. The fuel injection-start reference rotation speed Nref1 is regulated in this engine stop control routine as described later. FIG. 4 shows one example of the fuel injection stop range. In the fuel injection stop range, the air-fuel mixture is combustible at a first ignition timing (close to a top dead center TDC in the compression stroke) for a restart of the engine 22 after a stop of the engine 22. The combustion of the air-fuel mixture at the first ignition timing quickly raises the rotation speed Ne of the engine 22. In this embodiment, the fuel injection stop range is between the first angle CA1 in the latter half of the intake stroke and the second angle CA2 in the latter half of the compression stroke. In response to permission of fuel injection, the engine ECU 70 activates the fuel injection valve 32 to inject the fuel into the specified cylinder at a fuel injection timing in the last stage of the exhaust stroke.

Figure 5:
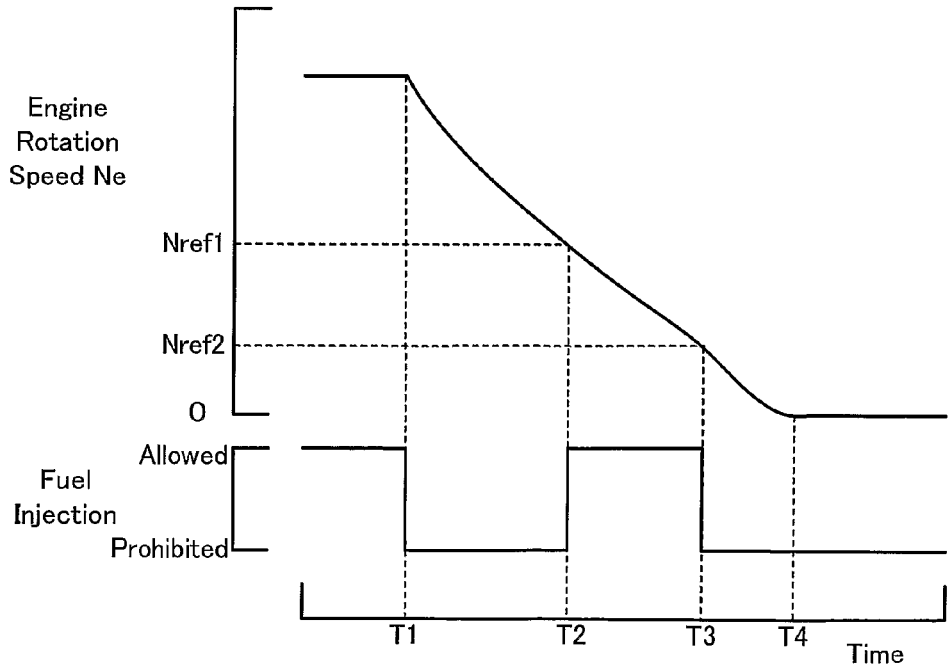
FIG. 5 shows time variations in rotation speed Ne of an engine and state of fuel injection under engine stop control.

The CPU 72 waits until the input rotation speed Ne of the engine 22 further decreases to or below a preset fuel injection-stop reference rotation speed Nref2 (steps S140 and S150), and then prohibits fuel injection (step S160). The fuel injection-stop reference rotation speed Nref2 is set as a minimum rotation speed that allows fuel injection in the specified cylinder, which is at a stop in the fuel injection stop range, immediately before a full stop of the engine 22. The fuel injection-stop reference rotation speed Nref2 is regulated in this engine stop control routine as described later. In response to prohibition of fuel injection, the engine ECU 70 cuts off the fuel again. FIG. 5 shows time variations in rotation speed Ne of the engine 22 and state of fuel injection under engine stop control. At a time point T1, a stop command of the engine 22 is given to prohibit fuel injection. At a time point T2, the rotation speed Ne of the engine 22 decreases to the fuel injection-start reference rotation speed Nref1 to allow fuel injection. At a time point T3, the rotation speed Ne of the engine 22 decreases to the fuel injection-stop reference rotation speed Nref2 to prohibit fuel injection again. At a time point T4, the rotation speed Ne of the engine 22 decreases to 0 to completely stop the engine 22.

After prohibition of fuel injection at step S160, the CPU 72 waits until the rotation speed Ne of the engine 22 decreases to 0 (steps S170 and S180). The CPU 72 then inputs the crank angle CA from the crank angle sensor 48 (step S190) and computes a stop angle CAs1 of a cylinder with fuel injection and a stop angle CAs2 of a cylinder without fuel injection over the intake stroke to the first half of the expansion stroke on the assumption of a top dead center (TDC) of the intake stroke equal to an angle 0 degree (step S200). In this embodiment, the fuel injection stop range is wider than 180 degrees as shown in FIG. 4. There may thus be two cylinders with fuel injection. In this case, the stop angles CAs1 of the respective cylinders are to be computed at step S200. Similarly there may be two cylinders without fuel injection, and the stop angles CAs2 of the respective cylinders are computed at step S200. The CPU 72 then determines whether the computed stop angle CAs1 of each cylinder with fuel injection is in the fuel injection stop range between the preset first angle CA1 and the preset second angle CA2 (step S210). When any cylinder with fuel injection has the stop angle CAs1 of greater than the preset second angle CA2 and stops out of the fuel injection stop range (CA2<CAs1), it is judged that the fuel injection-start reference rotation speed Nref1 is to be decreased. The fuel injection-start reference rotation speed Nref1 is thus subject to correction and is updated by subtracting a preset correction value ΔN from the current fuel injection-start reference rotation speed Nref1 (step S220). When any cylinder with fuel injection has the stop angle CAs1 of smaller than the preset first angle CA1 and stops out of the fuel injection stop range (CAs1<CA1), on the other hand, it is judged that the fuel injection-stop reference rotation speed Nref2 is to be increased. The fuel injection-stop reference rotation speed Nref2 is thus subject to correction and is updated by adding the preset correction value ΔN to the current fuel injection-stop reference rotation speed Nref2 (step S230). The fuel injection-start reference rotation speed Nref1 is to be decreased when the cylinder with fuel injection approaches to a top dead center of the compression stroke and stops out of the fuel injection stop range (CA2<CAs1). The fuel injection-stop reference rotation speed Nref2 is to be increased, on the other hand, when the cylinder with fuel injection approaches to a top dead center of the intake stroke and stops out of the fuel injection stop range (CAs1<CA1). Namely in the case where any cylinder with fuel injection stops out of the fuel injection stop range, the fuel injection-start reference rotation speed Nref1 or the fuel injection-stop reference rotation speed Nref2 is corrected to narrow the range between the fuel injection-start reference rotation speed Nref1 and the fuel injection-stop reference rotation speed Nref2. The decreasing correction of the fuel injection-start reference rotation speed Nref1 or the increasing correction of the fuel injection-stop reference rotation speed Nref2 enables the cylinder with fuel injection to stop in the fuel injection stop range (CA1≦CAs1≦CA2) even under the condition of the changing stop position of the engine 22 due to the varying state or the aging phenomena of the engine 22. When each cylinder with fuel injection stops in the fuel injection stop range (CA1≦CAs1≦CA2), it is expected that the air-fuel mixture is combustible at a next ignition timing of the cylinder in a restart of the engine 22. This case accordingly does not require either the decreasing correction of the fuel injection-start reference rotation speed Nref1 or the increasing correction of the fuel injection-stop reference rotation speed Nref2. The updated (decreased) fuel injection-start reference rotation speed Nref1 and the updated (increased) fuel injection-stop reference rotation speed Nref2 are stored in the engine ECU 70 and are kept even after ignition off.

The CPU 72 subsequently determines whether the computed stop angle CAs2 of each cylinder without fuel injection is out of the fuel injection stop range between the preset first angle CA1 and the preset second angle CA2 (step S240). When any cylinder without fuel injection has the stop angle CAs2 of not smaller than a bottom dead center (BDC) over the intake stroke to the compression stroke and of not greater than the preset second angle CA2 and stops in the fuel injection stop range (BDC≦CAs2≦CA2), it is judged that the fuel injection-start reference rotation speed Nref1 is to be increased. The fuel injection-start reference rotation speed Nref1 is thus subject to correction and is updated by adding the preset correction value ΔN to the current fuel injection-start reference rotation speed Nref1 (step S250). When any cylinder without fuel injection has the stop angle CAs2 of not smaller than the preset first angle CA1 and of not greater than the bottom dead center (BDC) over the intake stroke to the compression stroke and stops in the fuel injection stop range (CA1≦CAs2≦BDC), on the other hand, it is judged that the fuel injection-stop reference rotation speed Nref2 is to be decreased. The fuel injection-stop reference rotation speed Nref2 is thus subject to correction and is updated by subtracting the preset correction value ΔN from the current fuel injection-stop reference rotation speed Nref2 (step S260). After either the processing of step S250 or step S260, the CPU 72 terminates the engine stop control routine. The fuel injection-start reference rotation speed Nref1 is to be increased when the cylinder without fuel injection stops in the fuel injection stop range of the compression stroke (BDC≦CAs2≦CA2). The fuel injection-stop reference rotation speed Nref2 is to be decreased, on the other hand, when the cylinder without fuel injection stops in the fuel injection stop range of the intake stroke (CA1≦CAs2≦BDC). Namely in the case where any cylinder without fuel injection stops in the fuel injection stop range, the fuel injection-start reference rotation speed Nref1 or the fuel injection-stop reference rotation speed Nref2 is corrected to widen the range between the fuel injection-start reference rotation speed Nref1 and the fuel injection-stop reference rotation speed Nref2. The increasing correction of the fuel injection-start reference rotation speed Nref1 or the decreasing correction of the fuel injection-stop reference rotation speed Nref2 enables the cylinder without fuel injection to stop out of the fuel injection stop range (CAs2<CA1, CA2<CAs2) even under the condition of the changing stop position of the engine 22 due to the varying state or the aging phenomena of the engine 22. When each cylinder without fuel injection stops out of the fuel injection stop range (CAs2<CA1, CA2<CAs2), the engine stop control routine is terminated without the increasing correction of the fuel injection-start reference rotation speed Nref1 or the decreasing correction of the fuel injection-stop reference rotation speed Nref2. The updated (increased) fuel injection-start reference rotation speed Nref1 and the updated (decreased) fuel injection-stop reference rotation speed Nref2 are stored in the engine ECU 70 and are kept even after ignition off.

Figure 6:
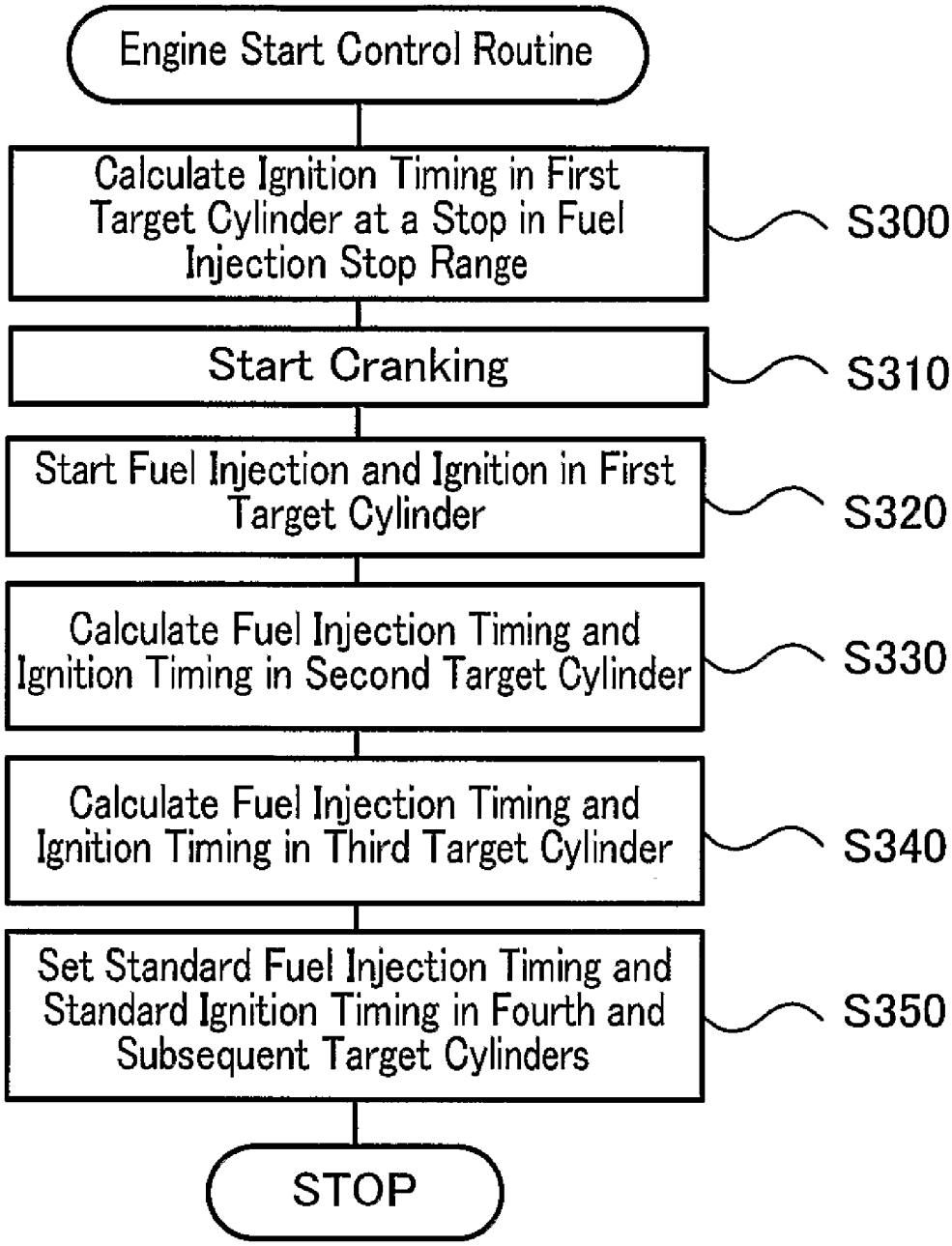
FIG. 6 is a flowchart showing an engine start control routine executed by the engine ECU.

FIG. 6 is a flowchart showing an engine start control routine executed by the engine ECU 70 under preset auto start conditions. In the engine start control routine, the CPU 72 of the engine ECU 70 first calculates an ignition timing in a first target cylinder, which is at a stop in the fuel injection stop range, based on the crank angle CA in a stop of the engine 22 (step S300). The engine stop control routine described above corrects the fuel injection-start reference rotation speed Nref1 and the fuel injection-stop reference rotation speed Nref2 to compensate for the changing stop position of the engine 22, for example, due to the aging phenomena of the engine 22.

Such correction allows fuel injection into the first target cylinder, which is at a stop in the fuel injection stop range, before a full stop of the engine 22. The engine start control routine accordingly calculates the ignition timing to ignite and combust the injected air-fuel mixture in the first target cylinder at a stop in the fuel injection stop range. The CPU 72 then initiates cranking (step S310), activates the fuel injection valve 32 and the ignition plug 42 to start fuel injection and ignition (step S320), and calculates a fuel injection timing and an ignition timing in a second target cylinder, which has an ignition timing after the first target cylinder stopping in the fuel injection stop range (step S330). For example, a restart of the engine 22 is assumed in the state where the first cylinder 22*a* has received fuel injection and has stopped at the crank angle CA of approximately 90 degrees in the compression stroke in the fuel injection stop range. The fuel injection timing and the ignition timing in this state are shown in FIG. 2. The third cylinder 22*c* as the second target cylinder having the ignition timing after the first cylinder 22*a* has stopped at the crank angle CA of approximately 90 degrees in the intake stroke and has received no fuel injection. For combustion of the air-fuel mixture at a first ignition timing in the third cylinder 22*c*, it is required to inject the fuel in the course of the intake stroke and introduce the injected fuel into the combustion chamber 40. The timing of fuel injection is thus to be set before the end of the intake stroke. In another example, a restart of the engine 22 is assumed in the state where the first cylinder 22*a* has received fuel injection and has stopped at the crank angle CA close to the preset second angle CA2 in the compression stroke in the fuel injection stop range. The third cylinder 22*c* as the second target cylinder having the ignition timing after the first cylinder 22*a* has stopped in the intake stroke in the fuel injection stop range and has received fuel injection. The calculation of the fuel injection timing is accordingly not required at step S330. The CPU 72 then calculates a fuel injection timing and an ignition timing in a third target cylinder having a third ignition timing (step S340), and sets a standard fuel injection timing and a standard ignition timing in fourth and subsequent target cylinders having fourth and subsequent ignition timings (step S350). The engine start control routine is terminated after the processing of step S350. The engine start control calculates the fuel injection timing and the ignition timing and performs fuel injection and ignition respectively at the calculated fuel injection timing and at the calculated ignition timing. Such control enables combustion of the air-fuel mixture in the specified cylinder that has received fuel injection and stopped in the fuel injection stop range, as well as combustion in the subsequent cylinders having subsequent ignition timings, in a restart of the engine 22. The combustion energy is thus effectively usable to raise the rotation speed Ne of the engine 22. This ensures a quick start of the engine 22.

In the internal combustion engine system 20 of the embodiment described above, the fuel injection stop range is specified as a combustible area of the air-fuel mixture at a first ignition timing in a start of the engine 22. When the cylinder with fuel injection stops out of the fuel injection stop range, the engine stop control corrects the fuel injection-start reference rotation speed Nref1, which represents the rotation speed Ne of the engine 22 for permission of fuel injection, to a smaller value or corrects the fuel injection-stop reference rotation speed Nref2, which represents the rotation speed Ne of the engine 22 for prohibition of fuel injection, to a greater value. Such control effectively prohibits fuel injection in the cylinder that stops out of the fuel injection stop range, even under the condition of the changing stop position of the engine 22 due to the varying state or the aging phenomenon of the engine 22. When the cylinder without fuel injection stops in the fuel injection stop range, on the other hand, the engine stop control corrects the fuel injection-start reference rotation speed Nref1 to a greater value or corrects the fuel injection-stop reference rotation speed Nref2 to a smaller value. Such control effectively ensures fuel injection in the cylinder that stops in the fuel injection stop range, even under the condition of the changing stop position of the engine 22 due to the varying state or the aging phenomenon of the engine 22. Adequate correction of the fuel injection-start reference rotation speed Nref1 and the fuel injection-stop reference rotation speed Nref2 effectively ensures fuel injection in the cylinder that is at a stop in the fuel injection stop range, thus enabling a quick start of the engine 22.

In an auto restart of the engine 22, the internal combustion engine system 20 of the invention calculates the ignition timing of the first target cylinder at a stop in the fuel injection stop range and the fuel injection timing and the ignition timing of the second and the third target cylinders having the second and the third ignition timings, and performs fuel injection and ignition at the calculated respective fuel injection timings and ignition timings. Such control ensures ignition and combustion of the air-fuel mixture in the first target cylinder that has received fuel injection and has stopped in the fuel injection stop range, as well as ignition and combustion in the subsequent target cylinders having the subsequent ignition timings, in the restart of the engine 22. The combustion energy is thus effectively usable to raise the rotation speed Ne of the engine 22. This ensures a quick start of the engine 22.

The internal combustion engine system 20 of the embodiment corrects the fuel injection-start reference rotation speed Nref1 or the fuel injection-stop reference rotation speed Nref2 with the fixed correction value ΔN, when the cylinder with fuel injection stops out of the fuel injection stop range or when the cylinder without fuel injection stops in the fuel injection stop range. The correction value of the fuel injection-start reference rotation speed Nref1 or the fuel injection-stop reference rotation speed Nref2 may otherwise be varied according to the stop angle CAs1 of the cylinder with fuel injection and the stop angle CAs2 of the cylinder without fuel injection. The correction value may be increased with an increase in distance of the stop position of the cylinder with fuel injection outwardly apart from the boundary of the fuel injection stop range. The correction value may be increased with an increase in distance of the stop position of the cylinder without fuel injection inwardly apart from the boundary of the fuel injection stop range.

The internal combustion engine system 20 of the embodiment corrects the fuel injection-start reference rotation speed Nref1 or the fuel injection-stop reference rotation speed Nref2 every time the cylinder with fuel injection stops out of the fuel injection stop range or the cylinder without fuel injection stops in the fuel injection stop range. One possible modification of engine stop control may correct the fuel injection-start reference rotation speed Nref1 or the fuel injection-stop reference rotation speed Nref2, when the cylinder with fuel injection repeatedly stops out of the fuel injection stop range multiple times or when the cylinder without fuel injection repeatedly stops in the fuel injection stop range multiple times.

In the internal combustion engine system 20 of the embodiment, the fuel injection stop range is set as an area over the intake stroke to the compression stroke. The fuel injection stop range may be limited to an area within the compression stroke.

The internal combustion engine system 20 of the embodiment controls fuel injection prior to an idle stop of the engine 22 in a drive gearshift position. In the drive gearshift position, the engine 22 automatically stops under the preset auto stop conditions, for example, the vehicle speed V equal to 0 and the driver's depression of the brake pedal 85, and automatically restarts under the preset auto start conditions, for example, the driver's release of the depressed brake pedal 85 after an auto stop of the engine 22. The technique of the invention is also applicable to control fuel injection prior to an idle stop of the engine 22 in a non-drive gearshift position, for example, a neutral position or a parking position. The non-drive gearshift position has a different friction under a stop of the engine 22 from the friction in the drive gearshift position. The fuel injection-start reference rotation speed Nref1 and the fuel injection-stop reference rotation speed Nref2 in the non-drive gearshift position may thus be stored separately from those in the drive gearshift position.

The embodiment discussed above is to be considered in all aspects as illustrative and not restrictive. There may be many modifications, changes, and alterations without departing from the scope or spirit of the main characteristics of the present invention. All changes within the meaning and range of equivalency of the claims are intended to be embraced therein.

INDUSTRIAL APPLICABILITY

The technique of the invention is preferably adopted in manufacturing industries of internal combustion engine systems and in automobile manufacturing industries.

The invention claimed is:

1. An internal combustion engine system including an internal combustion engine that has multiple cylinders and is capable of receiving fuel injection in an intake system in each of the multiple cylinders, said internal combustion engine system comprising:

a fuel injection unit that is capable of individually injecting a fuel into the intake system in each of the multiple cylinders of the internal combustion engine;

a rotation speed measurement unit that measures a rotation speed of the internal combustion engine;

an engine stop-time fuel injection control module that, in response to a preset operation stop command of the internal combustion engine, controls the fuel injection unit to make fuel injection in a cylinder that stops in a predetermined range including part of a compression stroke in an operation stop of the internal combustion engine, the control of the fuel injection unit by said engine stop-time fuel injection control module prohibiting fuel injection until the measured rotation speed of the internal combustion engine is lowered to a preset start rotation speed, allowing fuel injection while the measured rotation speed of the internal combustion engine is between the preset start rotation speed and a preset stop rotation speed, and prohibiting fuel injection again after the measured rotation speed of the internal combustion engine is lowered to the preset stop rotation speed;

a rotation stop position detection unit that detects a rotation stop position of a crankshaft of the internal combustion engine in the operation stop of the internal combustion engine; and a start rotation speed/stop rotation speed regulation module that regulates at least one of the start rotation speed and the stop rotation speed, based on the detected rotation stop position and a state of fuel injection in the cylinder stopping in the predetermined range.

2. An internal combustion engine system in accordance with claim 1, wherein said start rotation speed/stop rotation speed regulation module regulates at least one of the start rotation speed and the stop rotation speed to narrow a range between the start rotation speed and the stop rotation speed, when a cylinder stopping out of the predetermined range receives fuel injection.

3. An internal combustion engine system in accordance with claim 2, wherein said start rotation speed/stop rotation speed regulation module decreases the start rotation speed when the cylinder with fuel injection is close to a top dead center in the compression stroke and stops out of the predetermined range.

4. An internal combustion engine system in accordance with claim 2, wherein said start rotation speed/stop rotation speed regulation module increases the stop rotation speed when the cylinder with fuel injection is in an intake stroke before the compression stroke and stops out of the predetermined range.

5. An internal combustion engine system in accordance with claim 1, wherein said start rotation speed/stop rotation speed regulation module regulates at least one of the start rotation speed and the stop rotation speed to widen a range between the start rotation speed and the stop rotation speed, when the cylinder stopping in the predetermined range does not receive fuel injection.

6. An internal combustion engine system in accordance with claim 5, wherein said start rotation speed/stop rotation speed regulation module increases the start rotation speed when the cylinder without fuel injection is close to a top dead center in the compression stroke and stops in the predetermined range.

7. An internal combustion engine system in accordance with claim 5, wherein said start rotation speed/stop rotation speed regulation module decreases the stop rotation speed when the cylinder without fuel injection is in an intake stroke before the compression stroke and stops in the predetermined range.

8. An internal combustion engine system in accordance with claim 1, wherein the predetermined range includes parts of an intake stroke and the compression stroke.

9. An internal combustion engine system in accordance with claim 1, wherein the preset operation stop command is given under a preset auto stop condition in the process of automatically stopping the internal combustion engine and automatically restarting the stopped internal combustion engine.

10. An internal combustion engine system in accordance with claim 9, said internal combustion engine system further comprising:

an engine start control module that, under a preset auto start condition, ignites a mixture of the air and the fuel when the cylinder stopping in the predetermined range shifts from the compression stroke to an expansion stroke to start the internal combustion engine.

11. A motor vehicle driven with output power of an internal combustion engine that has multiple cylinders and is capable of receiving fuel injection in an intake system in each of the multiple cylinders, said motor vehicle comprising:

a fuel injection unit that is capable of individually injecting a fuel into the intake system in each of the multiple cylinders of the internal combustion engine;

a rotation speed measurement unit that measures a rotation speed of the internal combustion engine;

an engine stop-time fuel injection control module that, in response to a preset operation stop command of the internal combustion engine, controls the fuel injection unit to make fuel injection in a cylinder that stops in a predetermined range including part of a compression stroke in an operation stop of the internal combustion engine, the control of the fuel injection unit by said engine stop-time fuel injection control module prohibiting fuel injection until the measured rotation speed of the internal combustion engine is lowered to a preset start rotation speed, allowing fuel injection while the measured rotation speed of the internal combustion engine is between the preset start rotation speed and a preset stop rotation speed, and prohibiting fuel injection again after the measured rotation speed of the internal combustion engine is lowered to the preset stop rotation speed;

a rotation stop position detection unit that detects a rotation stop position of a crankshaft of the internal combustion engine in the operation stop of the internal combustion engine; and a start rotation speed/stop rotation speed regulation module that regulates at least one of the start rotation speed and the stop rotation speed, based on the detected rotation stop position and a state of fuel injection in the cylinder stopping in the predetermined range.

12. A motor vehicle in accordance with claim 11, wherein said start rotation speed/stop rotation speed regulation module regulates at least one of the start rotation speed and the stop rotation speed to narrow a range between the start rotation speed and the stop rotation speed, when a cylinder stopping out of the predetermined range receives fuel injection.

13. A motor vehicle in accordance with claim 11, wherein said start rotation speed/stop rotation speed regulation module regulates at least one of the start rotation speed and the stop rotation speed to widen a range between the start rotation speed and the stop rotation speed, when the cylinder stopping in the predetermined range does not receive fuel injection.

14. An internal combustion engine stop method that stops an operation of an internal combustion engine, said internal combustion engine having multiple cylinders and being capable of individually receiving fuel injection in an intake system in each of the multiple cylinders, said internal combustion engine stop method comprising the step of:

controlling fuel injection, in order to cause one of the multiple cylinders to receive fuel injection and to stop in a predetermined range over an intake stroke to a compression stroke in an operation stop of the internal combustion engine, said fuel injection control step comprising the steps of:

prohibiting fuel injection until an observed rotation speed of the internal combustion engine is lowered to a preset start rotation speed;

allowing fuel injection while the observed rotation speed of the internal combustion engine is between the preset start rotation speed and a preset stop rotation speed; and prohibiting fuel injection again after the observed rotation speed of the internal combustion engine is lowered to the preset stop rotation speed, said internal combustion engine stop method further comprising the step of:

regulating at least one of the start rotation speed and the stop rotation speed, based on a detected rotation stop position of a crankshaft in the operation stop of the internal combustion engine and a state of fuel injection in the cylinder stopping in the predetermined range over the intake stroke to the compression stroke in the operation stop of the internal combustion engine.

15. An internal combustion engine stop method in accordance with claim 14, wherein said regulating step regulates at least one of the start rotation speed and the stop rotation speed to narrow a range between the start rotation speed and the stop rotation speed, when a cylinder stopping out of the predetermined range receives fuel injection.

16. An internal combustion engine stop method in accordance with claim 14, wherein said regulating step regulates at least one of the start rotation speed and the stop rotation speed to widen a range between the start rotation speed and the stop rotation speed, when the cylinder stopping in thepredetermined range does not receive fuel injection.

* * * * *